United States Patent [19]

Vitale

[11] Patent Number: 4,962,546

[45] Date of Patent: Oct. 16, 1990

[54] MATTRESS PAD WITH STRETCH-WALL CONSTRUCTION

[75] Inventor: Joseph Vitale, Ft. Lauderdale, Fla.

[73] Assignee: Perfect Fit Industries, Inc., Monroe, N.C.

[21] Appl. No.: 383,387

[22] Filed: Jul. 20, 1989

[51] Int. Cl.[5] ..... A47G 9/02

[52] U.S. Cl. ..... 5/497; 5/500; 5/502

[58] Field of Search ..... 5/496, 497, 499, 500, 5/502

[56] References Cited

U.S. PATENT DOCUMENTS

| | | | |
|---|---|---|---|
| 1,748,743 | 2/1930 | Wedler . | |
| 1,771,872 | 7/1930 | Brock et al. | 5/496 X |
| 2,414,927 | 1/1947 | Chapman | 5/500 |
| 2,942,280 | 6/1960 | May, Jr. | 5/497 |
| 3,290,702 | 12/1966 | Seltzer | 5/497 |
| 3,670,345 | 6/1972 | Doll et al. | 5/500 |
| 4,042,986 | 8/1977 | Goodman et al. | 5/500 |
| 4,651,370 | 3/1987 | Vitale | 5/500 X |
| 4,672,702 | 6/1987 | Isham | 5/499 X |
| 4,682,379 | 7/1987 | Dugan | 5/500 |
| 4,703,530 | 11/1987 | Gusman | 5/499 |
| 4,720,415 | 1/1988 | Vander Wielen et al. | 428/152 |
| 4,781,966 | 11/1988 | Taylor | 428/152 |
| 4,801,482 | 1/1989 | Goggans et al. | 428/68 |

FOREIGN PATENT DOCUMENTS

| | | | |
|---|---|---|---|
| 929706 | 6/1963 | United Kingdom | 5/502 |
| 933420 | 8/1963 | United Kingdom | 5/502 |
| 1012503 | 12/1965 | United Kingdom | 5/500 |

*Primary Examiner*—Michael F. Trettel

*Attorney, Agent, or Firm*—Seidel, Gonda, Lavorgna & Monaco

[57] ABSTRACT

A mattress pad includes elastic side panels which retainingly engage the sides of the mattress. The mattress cover has a non-elastic top panel and a plurality of elastic side panels joined at the corners. The invention permits a secure engagement of mattresses within a wide variety of sizes and shapes.

4 Claims, 2 Drawing Sheets

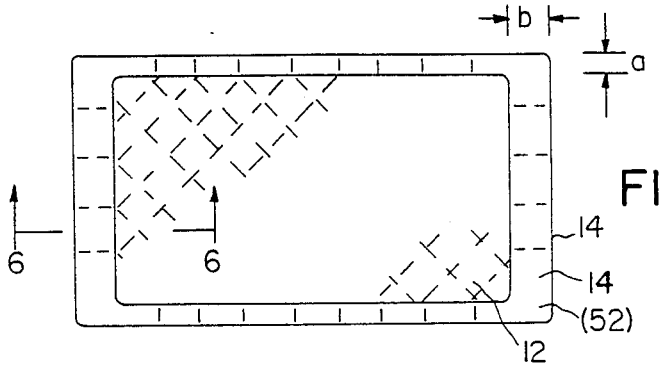
FIG.5
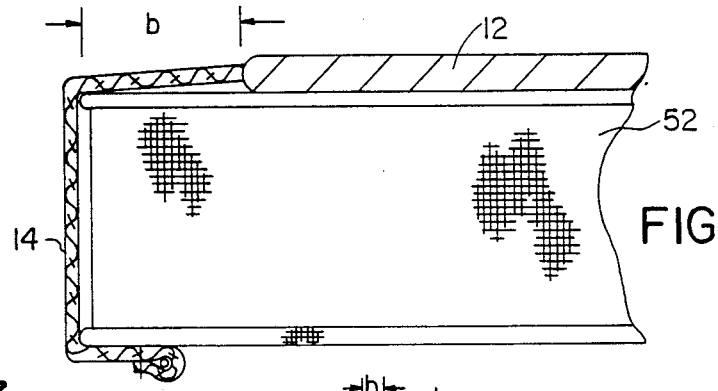
FIG.6
FIG.7
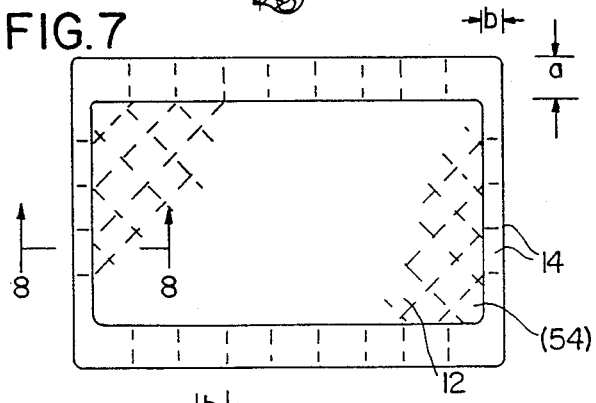
FIG.9
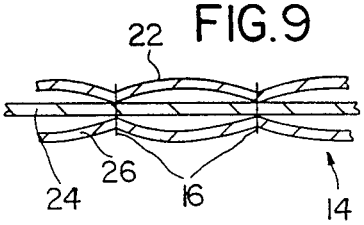
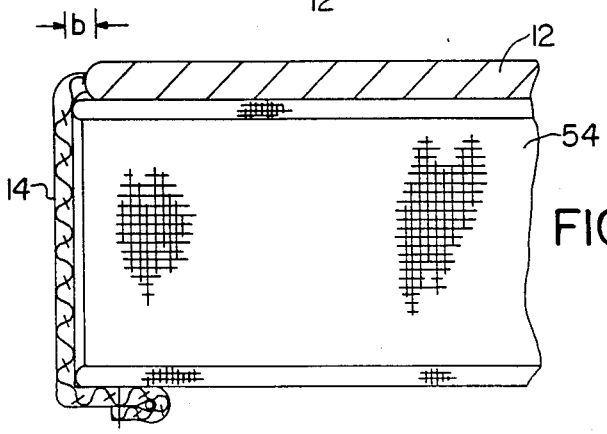
FIG.8

MATTRESS PAD WITH STRETCH-WALL CONSTRUCTION

FIELD OF THE INVENTION

The present invention relates to a fitted mattress pad having elastic side panels.

BACKGROUND OF THE INVENTION

Mattress pads, or mattress covers, for maintaining the cleanliness and neat appearance of mattresses are well known. Mattress pads generally comprise a top portion of a quilted fabric material or of a nonporous waterproof sanitary material such as a thin sheet of rubber, and some means for holding the pad onto the mattress.

Mattress pads may be simple pads which loosely overlie the top of a mattress or may be fitted to the mattress, in the same manner as a fitted sheet. In a typical fitted mattress pad, depending side panels are sewn or otherwise attached to the pad itself to secure the mattress pad to the mattress. In turn, some structure is provided to secure the side panels to the mattress so that the mattress pad will remain in place and not slip or be dislodged from the mattress. One such typical structure is to provide either a draw string or elastic band near the hem of the side panels. Other means for holding the mattress pad include providing side panels with triangular corner panels at the bottom of the side panels, so that the corners of the mattress pad engage the corners of the mattress.

It has been found that, even with the use of structure like those described for holding the mattress pad onto the mattress, the problem persists that the mattress pad tends to slip or even fall off the mattress merely because of the normal motions of a person sleeping on the bed. This problem is exacerbated by recent changes in what had previously been standard mattress sizes. Thus, where there had been for some years prevailing standards of mattress sizes in the bedding industry, recently manufacturers have been producing and marketing mattresses of nonstandard sizes. With many types of known mattress pads, the dimensions of the mattress pad must be very close to the dimensions of the mattress for the mattress pad to fit properly.

It is an object of the present invention to provide a mattress pad which will remain secured to a mattress more effectively than known mattress pads.

It is another object of the invention to provide a mattress pad which is able to fit over mattresses of a variety of lengths, widths, and thicknesses.

SUMMARY OF THE INVENTION

The invention is a mattress cover with a nonelastic top panel. The top panel is preferably, but need not be, quilted. Extending downwardly from the edges of the top panel is a plurality of side panels, which are joined together at the corners. The side panels are made of a material which is elastic in two dimensions. When the mattress pad is placed on a mattress, the side panels extend over the sides of the mattress to the bottom surface of the mattress. Because the side panels are elastic, the side panels retainingly engage the sides of the mattress.

In a preferred embodiment of the invention, the side panels are made from a laminate comprising three layers. The first, outermost layer is made of a woven material, such as linen, although a synthetic fabric may also be used. The second layer is made of a non-woven elastic material. The third layer is made of a non-woven, perforated material. The three layers are bonded together by seams which extend generally from the top panel to the bottom edges of the side panels.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 5–8 are alternate top plan views and cross-sectional views of the mattress pad of the present invention in place on two mattresses of different dimensions.

FIG. 9 is a cross-sectional view through line 9—9 in FIG. 1.

DETAILED DESCRIPTION OF THE INVENTION

Figure 1:
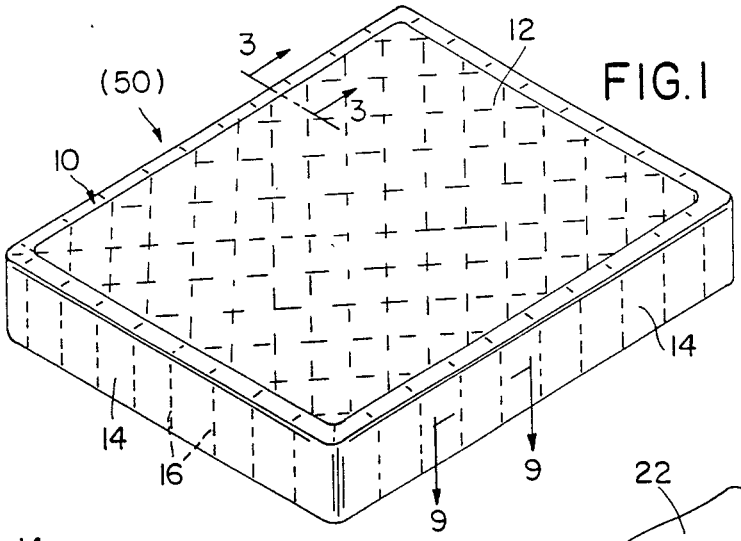
FIG. 1 is an isometric view of the mattress pad of the present invention in position on a mattress.

FIG. 1 is an isometric view of the mattress pad 10 of the present invention in place over a mattress 50 (covered by the mattress pad 10). Mattress pad 10 generally comprises a top panel 12 and four side panels 14. Top panel 12 is made of a non-elastic, preferably quilted material which will provide the desired softness to the top of the mattress. A non-porous sheet of sanitary material may also be incorporated in top panel 12. In addition, although it is preferred that the top panel be quilted, a non-quilted top panel is also within the scope of the present invention. Side panels 14 extend downwardly from the edges of top panel 12, and are joined at the corners to form a box-like shape generally following the proportions of the mattress. The side panels are of such a length that, when mattress pad 10 is placed around the mattress, the side panels 14 cover the sides of the mattress and extend some distance inwardly toward the center of the mattress on the bottom surface of the mattress, so that the edges of the side panels somewhat overlap the bottom surface of the mattress.

Figure 3:
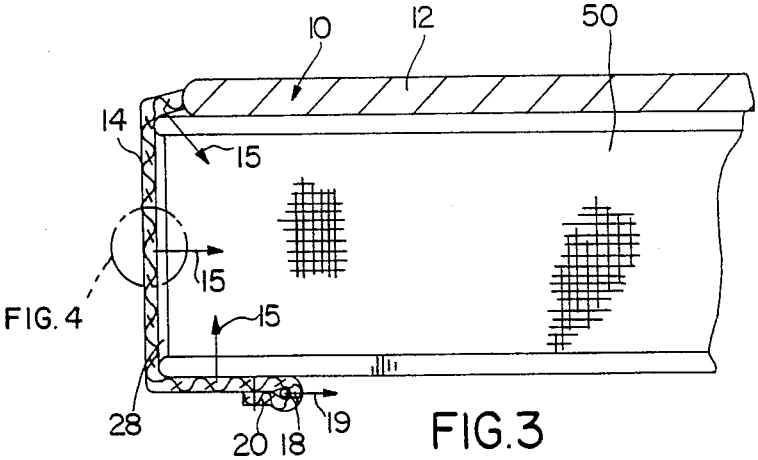
FIG. 3 is a cross sectional view of the mattress pad of the present invention engaged around a mattress.

FIG. 3 is a cross-sectional view through line 3—3 of FIG. 1, showing in detail how one of the side panels 14 engages the side and bottom surface of the mattress 50. It should be emphasized that the side panels 14 are made of an elastic material, the structure of which will be described in detail below. Because side panels 14 are elastic, when they are stretched over the sides of mattress 50, the natural resilience of the elastic material will cause the side panel 14 to retainingly engage the edges and sides of the mattress 50, and exerting inwardly directed forces, approximately as shown by vectors 15, which firmly hold mattress pad 10 in place on mattress 50.

At the bottom edge of the side panels 14 is an elastic band 18 which is attached to side panels 14 by means of a sewn-over hem 20. Either a single length of elastic or multiple lengths, for example one length in each side panel, may be used. The elastic passes through all four side panels 14 and causes an inward pull towards the center of the bottom of the mattress, approximately as shown by vector 19. Thus, the inward pull of vector 19 towards the center of the mattress and the inward pull of vectors 15 caused by the natural resilience of side panel 14 causes the mattress pad 10 to be securely engaged around all four sides of the mattress 50.

Figure 2:
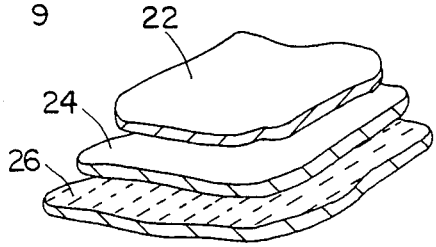
FIG. 2 is a cutaway view showing the laminated structure of the side panels.
Figure 4:
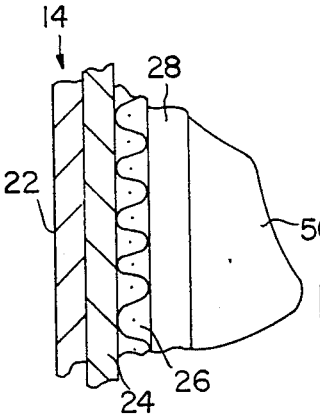
FIG. 4 is detailed view of the structure of the side panels.

FIGS. 2, 4 and 9 are detailed views of the structure of the side panels 14. The side panels are formed from a laminate having a three-layer structure. Layer 22, which is outermost when mattress pad 10 is in place on a mattress, is preferably made of a woven bedding material, such as linen. Just beneath layer 22 is an intermediate layer 24, which is made of a non-woven elastic material. A material particularly well-suited for intermediate layer 24 is disclosed in U.S. Pat. No. 4,720,415. Of course, the present invention does not require intermediate layer 24 to be of a particular material. All that is important is that intermediate layer 24 be elastic in two directions. Below layer 24 is a backing layer 26, which is preferably made of a non-woven material having a pattern of small perforations, which is known in the bedding art.

FIG. 4 shows a detail of the side panel 14 in position around a mattress 50. As seen in FIG. 4, there may in some cases be a small space 28 between side panel 14 and mattress 50, depending on the construction of the mattress. For example, many mattresses have peripheral seams along the top and bottom edges which extend a small distance past the sides of the mattress, as shown in the drawings.

Returning to FIG. 1, the three layers of side panels 14 are bonded together by seams 16 which extend generally between the top and bottom edges of the side panels. It has been found that the seams not only hold the layers together durably and reliably, but allow the elastic side panels 14 to more efficiently grip the edges of the mattress 50. The seams 16 are preferably formed by a simple sewing operation. Preferably, a plurality of seams are provided so that the three layers of the side panels are reliably secured together and so that the side walls have a pleasing appearance.

FIG. 9 shows a cross-sectional view of side panel 14, as viewed from a direction parallel to the direction of seams 16. In this view it can be seen that the layer 22 and backing layer 26 are bunched between seams 16. Layers 22 and 26 typically are not elastic, and so to provide for stretchability of the laminate in a direction perpendicular to the direction of seam 16, layers 22 and 26 are bunched so that the inelasticity of layers 22 and 26 will not restrain the stretching of layer 24. When the side panel 14 is stretched in a direction perpendicular to the seams 16, layer 24, being of an elastic material, will stretch normally, and the distance between seams 16 will increase. As the seams 16 spread apart, the bunching of layers 22 and 26 will flatten out, thereby restricting the distance the side walls 14 can stretch. The layers 22 and 26 are similarly bunched, although to a lesser extent, in a direction parallel to the seams 16, allowing some stretchability in that direction.

A key advantage of the present invention is that, because the side panels are elastic throughout their area, they can be stretched to fit over mattresses having a wide range of dimensions, and will retainingly engage the mattresses to an extent not possible in the prior art. FIGS. 5 and 6 and FIGS. 7 and 8 show how the mattress pad of the present invention adapts to fit over mattresses of varying lengths, widths, and thicknesses. Mattress 52 of FIGS. 5 and 6 and mattress 54 of FIGS. 7 and 8 are of different proportions; mattress 54 is wider and shorter than mattress 52. If the size of the top portion 12 of the mattress pad 10 is kept the same in both cases, the distances a and b that the side panels 14 must stretch to engage the sides of each of the mattresses will vary. As can be seen in comparing FIG. 6 to FIG. 8, side panel 14 can engage the sides and bottom edge of any mattress within a wide range of sizes, even for long or short distances b between the edge of the top panel 12 and the edge of the mattress. The elasticity of side panel 14 not only maintains a secure grip around the sides of the mattress, but enables the mattress cover 10 to adapt to mattresses of various proportions. The adaptability of mattress pad 10 not only applies to varying lengths and widths of the mattress, but also to the thicknesses of various mattresses within a wide range.

The present invention may be embodied in other specific forms without departing from the spirit or essential attributes thereof and, accordingly, reference should be made to the appended claims, rather than to the foregoing specifications, as indicating the scope of the invention.

I claim:

1. A mattress cover adapted to conformingly fit over a mattress, comprising:

a non-elastic top panel having a general shape similar to that of the top surface of the mattress, defining edges and corners;

a plurality of side panels attached to the edges of the top panel, adjacent side panels being attached to each other at the corners of the top panel, the side panels including a layer of woven bedding fabric, a layer of backing material, and a layer of non-woven elastic material therebetween, the layers being joined together by a network of seams, the fabric layer and backing layer being bunched between the seams whereby the side panels are stretchable in a first direction and stretchable to a lesser extent in a second direction perpendicular to the first direction.

2. A mattress cover as in claim 1, further comprising elastic means along the free edges of the side panels.

3. A mattress cover as in claim 1, wherein the top panel is quilted.

4. A mattress cover adapted to conformingly fit over a mattress, comprising:

a non-elastic top panel having a general shape similar to that of the top surface of the mattress, defining edges and corners; and a plurality of side panels attached to the edges of the top panel, adjacent side panels being attached to each other at the corners of the top panel, the side panels including a layer of woven bedding fabric, a layer of backing material, and a layer of non-woven elastic material therebetween, the layers being joined together by a network of sewn seams, the fabric layer and backing layer being bunched between the seams whereby the side panels are stretchable primarily in one direction.

* * * * *